10/30/84 XR 4,479,433

United States Patent [19]

MacPhee et al.

[11] Patent Number: 4,479,433

[45] Date of Patent: Oct. 30, 1984

[54] INK LEVEL CONTROL

[75] Inventors: John MacPhee, Rowayton; Peter Van Raalte, Wilton, both of Conn.

[73] Assignee: Baldwin-Gegenheimer Corporation, Stamford, Conn.

[21] Appl. No.: 142,665

[22] Filed: Apr. 21, 1980

Related U.S. Application Data

[63] Continuation of Ser. No. 898,925, Mar. 21, 1978, abandoned.

[51] Int. Cl.[3] ..... B41F 31/02

[52] U.S. Cl. ..... 101/364; 73/290 V

[58] Field of Search ..... 101/364, 366, 350, 363, 101/365, 148, 207, 208, 210, 315, 321, 326, 330, 340, 344, 347, 355, 356, 360; 340/1 L; 73/290 V, 290 R; 343/5 NA, 7 R, 12 A; 222/64; 137/386, 391

[56] References Cited

U.S. PATENT DOCUMENTS

| | | | |
|---|---|---|---|
| 2,813,538 | 11/1957 | Genova | 101/364 X |
| 3,025,793 | 3/1962 | Vischulis | 101/350 |
| 3,373,052 | 3/1968 | Rode | 101/364 X |
| 3,407,398 | 10/1968 | Stearn | 73/290 V |
| 3,848,529 | 11/1974 | Gegenheimer | 101/363 |
| 3,985,030 | 10/1976 | Charlton | 73/290 V |
| 4,000,650 | 1/1977 | Snyder | 73/290 V |
| 4,010,683 | 3/1977 | Lambert et al. | 101/366 |
| 4,090,407 | 5/1978 | Shuler | 73/290 V |
| 4,121,094 | 10/1978 | Divito et al. | 340/1 L |
| 4,144,517 | 3/1979 | Baumoel | 73/290 V X |

OTHER PUBLICATIONS

*Instrumentation Technology*, "Ultrasonic Instruments for Level and Flow", Sep. 1974, pp. 49–59.

"Sensall System 8100 Ultrasonic Continuous Liquid Level Transmitter", Envirotech Brochure; National Sonics, 250 Marcus Boulevard, Hauppauge, New York 11787.

*Primary Examiner*—J. Reed Fisher

*Attorney, Agent, or Firm*—St. Onge, Steward, Johnston & Reens

[57] ABSTRACT

An ink level control for a printing press is disclosed having an ultrasonic ink level sensor to receive an echo signal representative of the level of the ink in the ink fountain. A control is provided whereby the ink level is maintained at a desired operating level and conditions of excessively low and high ink levels are also detected by the sensor. An echo loss detection network is provided to warn the operator and inhibit ink feeds. The control is designed to prevent overflow of the ink fountain.

15 Claims, 2 Drawing Figures

INK LEVEL CONTROL

This is a continuation of application Ser. No. 898,925 filed Mar. 21, 1978, now abandoned.

FIELD OF THE INVENTION

This invention relates to an apparatus for controlling the ink level in an ink fountain used in a printing press such as the viscous ink in an offset lithographic press.

BACKGROUND OF THE INVENTION

The ink consumption in a modern, high speed printing press is very large and as a result, ink is frequently pumped to the press in pipes installed for that purpose.

Most offset printing inks are quite viscous, and are comparable to very thick molasses in this respect. As a result, ink neither flows readily, nor seeks its own level quickly. When the valve in the ink line is opened to introduce additional viscous ink into an ink fountain used in a printing press, the new ink takes a long time to level out.

Ink generally is considered an active substance in the sense that the ink sets when allowed to stand and dries when exposed to air. In addition, ink is sticky and readily adheres to all commonly used materials. These properties pose a difficulty in sensing ink level since the ink has a tendency to accumulate or build up on any sensing member or component with which the ink comes into contact.

Typically, the ink fountain or reservoir in an offset printing press is constructed in the form of a trough such as shown in U.S. Pat. No. 3,848,529 to Gegenheimer et al, which is assigned to the same assignee of this invention. The ink trough is formed by a flat blade which forms a nip with a fountain roller. A feature of such reservoir is that the surface of the ink contained therein is not flat, but usually undulates while the press is in operation at a frequency in the range from 0.25 to once a second. This undulation is produced by a ratchet action of a fountain roller and makes it difficult to sense the ink level.

Ink fountains in many printing presses are commonly equipped with ink agitators which improve ink distribution, prevent the formation of surface skin and improve feeding of the ink to the nip between the flat blade and the fountain roller. The main element of an ink agitator may be in the form of a conically shaped roller which is caused to rotate while traveling to and fro the length of the ink fountain. Such roller is illustrated in the aforementioned Gegenheimer et al patent. The presence of an agitator produces a wave in the ink of a height which may be of the order of an inch or even more. When the ink is so disturbed, its surface quivers and undulates so as to make it difficult to sense ink level.

The space above the ink fountain must be kept relatively clear to allow room for the operator of the printing press to clean the fountain or to enable ink to be fed manually for occasions when special or spot colors are necessary. As a result, the sensing of ink level must be done in such manner that the area or space over the ink fountain is not unreasonably obstructed.

When multi-color printing presses having many ink fountains are involved, a plurality of ink level control systems are employed. On any particular printing operation, however, it may not be necessary to use all of the ink fountains. As a result, some of the unused fountains may not have any ink and the ink level control must be able to sense such condition to avoid system malfunctioning.

A large number of automatic ink level sensor designs have been proposed. Ink level sensors may use floating, tactile, capacitance, pneumatic or ultrasonic techniques. U.S. Pat. No. 3,025,793 describes an ink level control for a newspaper press utilizing a float operated ink feed valve. Although such an approach is workable in newspaper presses, which utilize relatively thin or low viscosity inks, the float concept is not feasible in commercial presses requiring thicker inks. A major difficulty encountered with a floating device resides in the accumulation of ink on the float, eventually rendering it inoperable. The float also tends to take up a large amount of space, particularly when such float is directly connected to operate an ink flow control valve.

The U.S. Pat. No. 3,373,052 and the previously mentioned Gegenheimer et al patent are examples of ink level controls wherein a tactile type sensor detects the ink level by touching the ink. Such sensor does not circumvent the difficulties due to ink activity and, as a result, the sensor tactile element must be periodically cleaned for reliable operation.

In the aforementioned Gegenheimer et al patent, a tactile sensor is employed to monitor the height of the wave of ink generated by an agitator, thereby overcoming the difficulty posed by the waves in measuring the ink level. Gegenheimer et al also discloses the use of an adjustable timer to limit the duration of ink feed to overcome the difficulty posed by the high ink viscosity which prevents an even ink level from being quickly established when the ink valve is opened. In one form for such timer, adjustable feed pulses are applied through a relay to actuate the ink valve. The width of the feed pulses and the intervals between the pulses can be selected.

A number of prior art systems employ sensors which avoid ink contact by using the capacitance principle. In one approach, such as disclosed in the U.S. Pat. No. 4,010,683, a plate is mounted above the ink fountain to form an electrical capacitor with the ink fountain blade. Since the permitivity of ink differs significantly from air, the capacitance will vary with ink level and thus provides a non-contacting method for detecting ink level. This sensor design has a disadvantage in that the sensor must be located within approximately an inch of the ink surface, thus obstructing access to the fountain.

A pneumatic ink level measuring system is available in the form of a vertical tube which is inserted into the ink fountain. The tube is connected to a source of air and the pressure in the tube is monitored to obtain a measure of ink level. This concept is satisfactory for low viscosity inks but difficult to apply to highly viscous offset printing press inks.

Ultrasonic techniques for detecting the level of liquids are well known and have been applied to ink level controls in a limited liquid contacting manner. A general description of ultrasonic techniques can be found in an article entitled "Ultrasonic Instruments for Level and Flow" in the September, 1974 issue of *Instrumentation Technology.*

Ultrasonic systems for determining liquid level utilize one of two basic approaches. In a first liquid contacting type, a detector provides an on-off signal when the liquid comes into contact with the ultrasonic sensor; see, for example, U.S. Pat. No. 3,520,186 to Adams et al. The liquid level may interrupt ultrasonic waves or cause a change in the dampening characteristics of an ultrasonic transducer when it is contacted by the liquid. Contact by the detector with ink, however, is not desirable.

In another type of ultrasonic level detector, an echo ranging principle is employed, such as described in the U.S. Pat. No. 3,985,030 to Charlton. A pulse of ultrasonic energy is directed to a transducer toward the liquid surface. A receiver listens for an acoustic echo and the time required for the echo to return provides a measure of the distance between the ultrasonic transducer and the liquid surface. In the Charlton patent, a loss of echoes is detected and used to override an automatic level indicator by registering a maximum liquid level depth.

SUMMARY OF THE INVENTION

In an ink level control in accordance with the invention, the ink level is sensed remotely with an ultrasonic pulse-echo technique. An accurate ink level control is provided capable of detecting ink level even in the presence of a quivering, undulating ink surface and an agitator wave, while providing operational safeguards for reliable and fail-safe operation.

As described with reference to one embodiment for an ink level control in accordance with the invention, an ultrasonic transducer is selected of a type capable of operating within normally encountered space restraints near the ink fountain of a printing press. The transducer can be remotely spaced from an ink fountain to enable access for cleaning, yet can be mounted within the available space and provide a reliable sensor of the ink surface as a result of acoustic pulses directed at the ink. Acoustic reflections from the ink are detected and processed to produce a measured ink level signal representative of the ink level in the fountain. An averaged or smoothed measured ink level signal is compared with a reference representative of a normally desired ink level in the fountain and the comparison used to provide an ink feed signal.

The ink feed signal is thereupon converted to ink feed pulses separated by intervals of a predetermined duration. Various ink feed limitations are applied to assure the proper feed of ink in a manner whereby the ink fountain is prevented from overflow. With such controls an accurate, non-contacting ultrasonic ink level sensor can be used to maintain the ink level at a desired level while preventing an excessive feed of ink to the fountain.

As further described with reference to a preferred embodiment of the invention, an echo loss detection network is used to detect when echoes are not received. Such loss may arise from the passage of the agitator's ink wave in the path of the ultrasonic beam. When an echo loss occurs, a simulated ink feed signal is produced to maintain normal operation of the ink level control. In the event the echo loss persists longer than a particular time, an alarm is generated.

The echo loss detector is particularly useful during field installation of the ink control when the ultrasonic transducer is aligned at the ink surface. The echo loss detector is visually monitored by observing an alarm light energized by an activated echo loss detector. Accurate alignment of the transducer may then be achieved by angularly moving the transducer to determine its angular operating range over which an echo can be obtained. The transducer is then fixed at a midway position of the operating range. This procedure, when carried out for transverse planes which are also normal to the ink surface, provides a convenient technique for using and field aligning of a narrow beam ultrasonic transducer.

In the described ink level control in accordance with the invention, both high and low ink level reference signals are generated to define an acceptable range of ink level within the ink fountain. The measured ink level signal is compared with these reference signals to generate an alarm when the measured ink level falls outside this acceptable range. Enhanced protection is provided by inhibiting the feeding of ink when the ink level drops below its acceptable low level. This feature prevents ink spills when the fountain is opened for cleaning.

It is, therefore, an object of the invention to provide an ink level control which overcomes the previously described disadvantages while enabling an accurate, reliable control of the ink level in an ink fountain of a printing press.

These and other advantages and objects of the invention can be understood from the following description of an embodiment described in conjunction with the drawings.

DETAILED DESCRIPTION OF EMBODIMENT

Figures 1, 2:
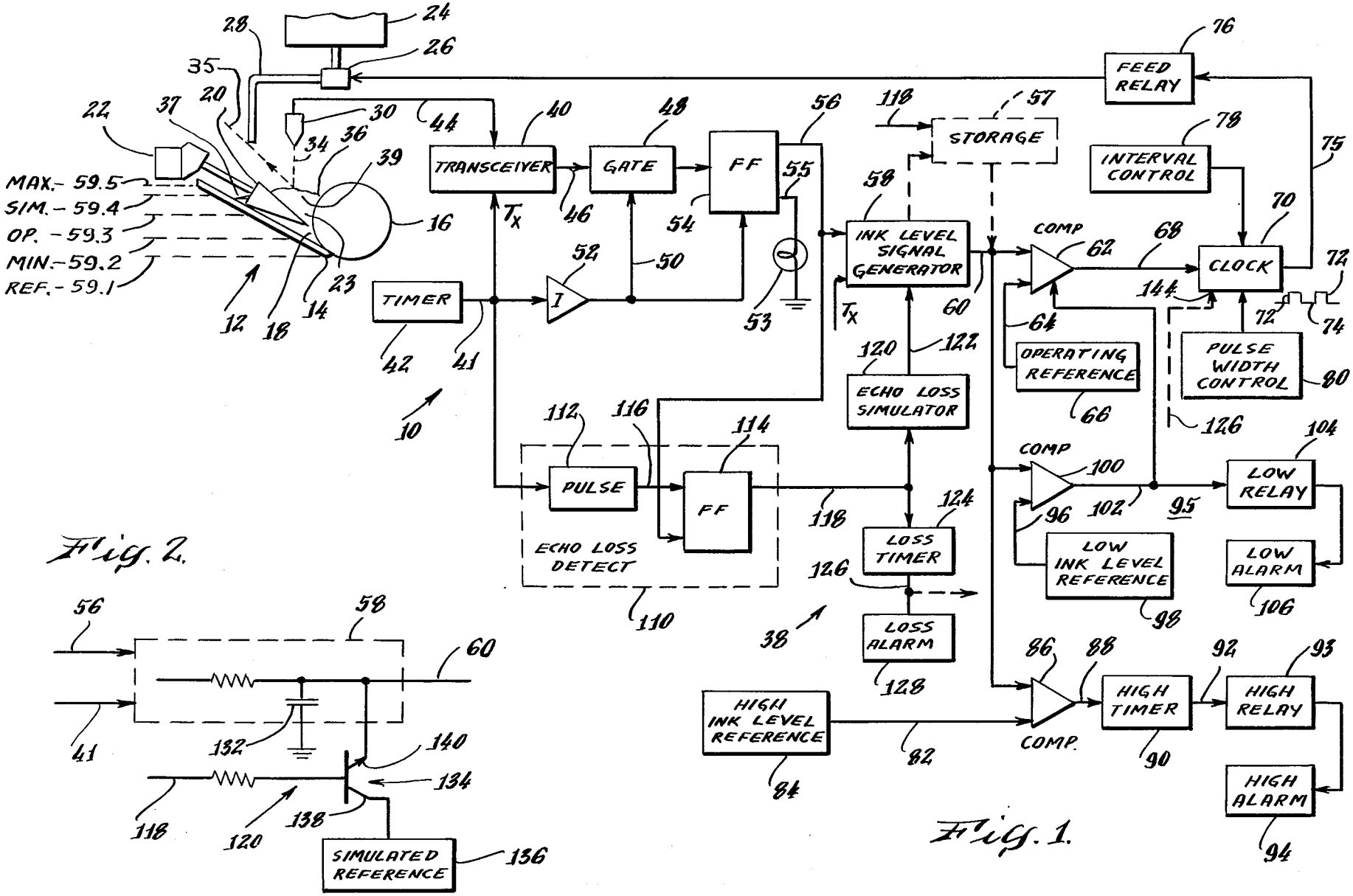
FIG. 1 is a schematic block diagram of an ink level control in accordance with the invention for use with a printing press.
FIG. 2 is an electrical schematic of a simulated ink feed signal generator for use in an ink level control in accordance with the invention.

With reference to FIG. 1, an ink level control 10 for a printing press (not shown) is described. An ink fountain 12 as generally described and shown in the Gegenheimer et al U.S. Pat. No. 3,848,529 is illustrated with a fountain blade 14 and an ink fountain roller 16 converging at a nip 18. The ink fountain 12 may be provided with an agitator 20 which is moved to and fro as described in the Gegenheimer et al patent with a suitable actuator 22. The fountain roller 16 is periodically actuated with a ratchet mechanism (not shown). Ink 23 is supplied to the fountain 12 from a supply 24 through an automatically controlled ink feed valve 26 and conduit 28. Other ink feed supply elements such as a pump have been deleted for clarity. The ink surface 36 tends to distort from its normal level as shown at 37 depending upon the frequency of operation of the agitator 20, fountain roller 16 and the viscosity of the ink. A more or less permanent quivering and undulated bulge such as 39 extending over the length of the fountain 12 is often encountered.

An ink level sensor 30, in the form of an ultrasonic transducer, is disposed at a suitable distance from the ink fountain 12 to direct acoustic pulses along a beam axis 34 transversely onto the surface 36 of the ink 23. The transducer 30 is selected of a type capable of generating acoustic pulses and providing an echo signal representative of acoustic returns or echoes from the ink surface 36 within the available space of a printing press. The transducer 30 must be capable of operating within the available space above the fountain 12. Since the transducer must operate in air, it tends to produce an undamped acoustic pulse followed by undesirable ringing effects and a greater spacing from the ink is needed to allow such trailing acoustic transients to die down. With the printing press's space limitation, however, the increased spacing frequently is difficult to accommodate and a high frequency transducer, capable of operating in the range of about 200 KHz is preferred. Such higher frequency transducer 30 enables one to employ remote acoustic ink surface sensing on printing presses with acceptable accuracies. The high frequency transducer, however, has a narrow beam, of the order of about six degrees. Hence, the transducer 30 is also carefully aligned and positioned to sense the various ink surfaces encountered on printing presses.

A control network 38 is provided to actuate transducer 30 and respond to the echo signal for control over the ink level in fountain 12. Ultrasonic transducers capable of generating and detecting acoustic pulses are well known and need not be further described.

Transducer 30 is controlled with a transceiver 40 formed of a digital circuit as may be commonly purchased. The transceiver 40 responds to pulses, Tx, on line 41 from a timer 42 which may generate these at a high rate of the order of 100 pulses per second. Each transmitter pulse causes the transceiver to deliver a large driving pulse on line 44 to transducer 30 which generates an acoustic pulse towards the ink surface 36. Acoustic returns from ink surface 36 are detected by transducer 30, amplified by transceiver 40 and made available as an echo signal for processing on an output line 46.

The echo signal is applied to a gate 48 which is normally enabled by the level on line 50 from an inverter 52 coupled to the timing pulses Tx from timer 42. While pulses Tx are active, gate 48 is disabled. This prevents erroneous responses when transducer 30 generates an acoustic pulse. If desired, a longer lasting inhibition of gate 48 may be obtained by replacing inverter 52 with a pulse network whose output pulse would last while an acoustic return from ink surface 36 could not occur; for example, an inhibiting pulse lasting for slightly less than the round trip transit time of the acoustic energy could be used. The disabling level on line 50 is also applied to reset a flip-flop 54.

When gate 48 is enabled and receives an echo signal from transceiver 40, flip-flop 54 is set to provide an echo signal on line 56 to an ink level signal generator 58. The latter is responsive to transmitter pulses Tx on line 41 and the echo signal from flip-flop 54 to measure the time therebetween and produce, on output line 60, an ink level signal representative of the actual ink level in fountain 12.

Techniques for measuring the transit time of an acoustic pulse to a reflecting surface are well known in the art. Hence, the measurement of the distance between transducer 30 and ink surface 36 can be carried out with a variety of different ink level signal generators 58. The latter may be an analog or digital circuit capable of providing a signal representative of the ink level.

Since transducer 30 provides an echo signal at a time which is a function of the spacing of transducer 30 from ink surface 36, the ink level signal is similarly related. However, by placing transducer 30 a fixed known distance from ink fountain 12, the ink level signal on line 60 represents actual ink level in the fountain referenced relative to, for example, the deepest level 59.1 at nip 18.

The ink level signal on line 60 is applied to a comparator 62 together with a reference signal representative of an operating ink level 59.3 desired to be maintained in fountain 12. This reference signal is obtained on line 64 from a suitable network 66 and a resulting comparison is produced as an ink feed signal on output 68 of comparator 62 when the ink level, as measured, drops below the operating reference. The comparator 62 is of a type which does not present an output as long as the measured ink level is above the operating level. When the ink feed signal occurs on output 68 of comparator 62 it enables a clock 70 which generates ink feed pulses 72 separated by ink leveling intervals 74 on line 75. The ink pulses 72 are applied to an ink feed relay 76 coupled to operate valve 26 and enable ink to flow into fountain 12.

Clock 70 has an interval control network 78 to control the duration of intervals 74 and a pulse width selection network 80 to regulate the widths of pulses 72. The pulse widths are selected to be long enough to keep up with the printing press's utilization of ink, but not so long that the fountain would overflow.

The intervals 74 must be long enough to allow the ink to level out in between feeds to prevent an overflow, but short enough to keep up with the ink utilization of the printing press.

The interval control network 78 sets the time between successive pulses 72. This interval is made sufficiently long to enable a change in the ink level to be registered in response to a previous ink supply pulse. The duration is a function of viscosity with more viscous inks requiring longer intervals.

For a practical application, the pulse widths may be of the order of 1 to 15 seconds separated by intervals of 15 seconds for an ink having a viscosity of the order of 200 poise.

The ink level control 10 maintains ink in the fountain below maximum level 59.5 by applying a high ink level reference signal on line 82 from a reference source 84 to a comparator 86. The high ink level reference signal represents the maximum acceptable ink level 59.5 in the fountain 12 and is compared with the measured ink level signal on line 60 to produce an alarm on comparator output 88 when the ink level exceeds the maximum level 59.5.

From time to time an ink wave, such as caused by the action of the agitator 20, generates an acoustic return which causes the measured ink level signal on line 60 to temporarily represent an ink level above the maximum level 59.5. In such case comparator 86 may produce an alarm signal on output 88. Since such alarm condition is of short duration, a timer 90 is employed to screen out momentary high ink level detections. Timer 90 is of a type whereby the high ink level alarm on line 88 must persist for a minimum time period to cause a high ink level alarm on output 92 to activate a high level relay 93. The relay may be used to sound an audible alarm 94.

The ink level in fountain 12 is normally kept at or above operating level 59.3. If, notwithstanding such control, the ink level drops below the operating level 59.3 and also below minimum level 59.2, the condition is identified as a malfunction with a minimum level control 95.

The measured ink level signal on line 60 and a low ink level reference signal on line 96, representative of minimum level 59.2 and generated by a source 98, are compared by a comparator 100. If the measured ink level drops below minimum 59.2, a low ink level alarm signal is produced on comparator output 102.

Since a low ink level alarm is construed as a malfunction of the system, such as may occur if the ink fountain is in an open unused condition, the comparator output 102 is applied to an inhibit input of comparator 62 to inhibit it from generating an ink feed signal on line 68. Comparator output 102 is also applied to a relay 104 to operate such devices as appear necessary to respond to such low ink level condition since the low level may also be due to valve 26 being stuck or the ink supply being depleted. Relay 104 may, for example, sound an audible alarm 106.

The use of ultrasonic transducer 30 provides the advantage of remote sensing of the ink level. However, from time to time the ink surface 36 is not level so that acoustic returns are reflected in the direction of arrow 35 instead of back onto transducer 30. As a result, an echo may be lost and no echo signal produced on line 56. In order to avoid a misinterpretation of such echo loss as an excessively low ink level, the loss of echo signal is detected with a network 110 and an appropriate ink level signal is simulated and provided on line 60.

Echo loss detector 110 includes a pulse network 112 which sets a flip-flop 114 in the event an echo signal fails to occur on line 56 within a certain time period following a transmitter pulse Tx. If an echo signal does occur, the setting pulse from pulse network 112 is ineffective since the echo signal on line 56 from flip-flop 54 is applied to maintain flip-flop 114 in its reset state.

In the event no echo is detected, the reset level on line 56 to flip-flop 114 is not present and the output pulse on line 116 from pulse network 112 sets flip-flop 114 to provide an echo loss signal on flip-flop output 118.

With the generation of an echo loss signal on line 118, an echo simulator circuit 120 is activated to provide a simulated ink level signal on line 122 representative of an ink level 59.4 between the operating level 59.3 and maximum level 59.5. The ink level signal is applied to network 58 and appears on line 60 as long as echoes are lost. As soon as an echo signal again is produced, flip-flop 114 is reset and the simulated ink level signal on line 118 deactivated.

In the event an echo loss condition persists for an excessive time period, a malfunction signal is produced with a timer 124 actuated by the echo loss signal on line 118. Timer 124 generates an alarm signal on line 126 for actuation of an appropriate alarm 128.

FIG. 2 illustrates an analog form of echo simulator 120 for generating a simulated ink level signal. The simulator operates with an ink level signal generator 58 of an analog type whereby the average voltage from flip-flop 54 (proportional to ink level) is stored in a capacitor 132.

When an echo loss signal occurs on line 118, it closes a transistor switch 134 having a simulated reference level signal from a source 136 coupled to a power electrode 138 such as the collector. The other power electrode 140, the emitter, is coupled to capacitor 132 to clamp its voltage to the simulated reference level from source 136. Hence, as long as an echo loss condition persists, a simulated ink level signal is provided on line 60.

A particular advantage of capacitor 132 involves its smoothing effect upon the ink level signal. Such smoothing is desirable in view of the occasional loss or changes in the arrival time of an echo signal due to the vibratory and disturbed nature of the ink surface 36. This smoothing is done over a time period sufficient to average a desired number of echo signals. A time constant associated with the charging of capacitor 132 may be of the order of about a third of a second.

The ink level control in accordance with the invention can be obtained with a digital network. For example, a microprocessor may be programmed to respond to the transceiver output 46 and transmitter pulses, Tx, to provide a digital echo signal. One method in which this can be done is to enable an internal microprocessor clock to enter pulses into a register and terminate this when the transceiver generates an echo signal. The accumulated count in the register represents the two-way travel time of an ultrasonic pulse from transducer 30 to ink surface 36. The actual distance is directly proportional to the travel time and can be derived using a value of the speed of sound in air.

The distance value effectively represents the measured ink level by virtue of the of the known distance between the transducer and the bottom level 59.2 of the ink fountain. The distance value is thus converted to a measured ink signal within the microprocessor and stored in a suitable memory location. A suitable averaging technique may be employed to smooth out the effect of ink level surface variations. The number of travel time or distance measurements to be averaged depends upon the travel speed of the agitator 20 and the size and frequency of the vibrations of the ink surface 36. In a pulse echo ink level control which generates of the order of about 100 echo pulses per second, the averaging of about 50 measured travel times can be used.

The stored ink level signal is then compared with various previously stored digital values for the high, low and operating levels to provide an ink feed signal to the ink feed valve 26. An echo loss can be detected by comparison with a particularly low ink level reference value such as 59.1. The digital form of ink level control 10 may thus take the form of a programmed microprocessor or with discrete digital circuits as may appear desirable. For purposes of illustration, with the control as shown in FIG. 1, a digital form of the measured ink level signal such as developed either by generator 58, or its digital counterpart, is stored in a memory such as represented by storage network 57. This storage may be a location in a microprocessor memory or a particular output register for subsequent comparison with the reference signals. The stored ink level signal is retained until replaced as a result of a new measurement with an echo signal.

When a loss of echo signals is sensed, such as with detector 110, the newly measured ink level will appear as an excessively low ink level and should not be used. Therefore, the output on line 118 is applied to network 57 to prevent replacement of the previously stored digital measured ink level signal. Such effect may, for example, be obtained by blocking the input to register 57 with suitable logic gates. Hence, when an echo loss occurs, a previously measured ink level signal is used to simulate the current ink levels. This condition persists until an echo signal is again detected.

It may be preferred to simulate a digital ink level measurement of a known ink level to avoid maintaining an ink level signal which demands a feed of ink. In such case the detection of an echo loss on line 118 is used to replace the digital signal in storage network 57 with one representative of a predetermined ink level to avoid ink fountain overflows as may occur when the previous ink level measurement sensed a low ink level. Such digital simulated predetermined ink level signal may be generated as soon as an echo loss is detected or may, for example, be obtained from a digital form of the simulated reference source 136 as shown in FIG. 2 such as can be stored in a memory location of a microprocessor.

In some cases it may be convenient to employ the signal on the output 126 from timer 124 directly to an inhibit input 144 of clock 70. This would automatically inhibit the feed of ink in case of an extended period over which an echo loss may arise. In such case, care must be taken to avoid a momentary erroneous occurrence of an ink level signal indicating a need for ink feed as soon as echoes are sensed again.

The echo loss detector 110 may be conveniently employed to align the ultrasonic transducer 30 onto ink surface 36. This is done by mounting transducer 30 for pivoting in transverse planes which are also normal to ink surface 36. The transducer 30 is then pivoted until the echo is lost as observed by detecting a visual alarm 128 energized by detector 110. The middle of the pivot range for each plane is then selected as the aligned position of transducer 30.

In the embodiment shown in FIG. 1 the described alignment procedure may also be carried out by observing a light source 53, such as an LED, driven by the reset output 55 of flip-flop 54. During normal operations the output 55 will be off most of the time and hence a very dim LED output is obtained as a sensing of the proper operation of the ink level control. When an echo is lost, however, the reset output 55 will be continuously on and as a result the LED output significantly brighter. When operational functions of the flip-flop 54 and related segments of control 10 are provided inside a microprocessor alignment of transducer 30 can be carried out by monitoring alarm 128.

Having thus described a printing press ink level control in accordance with the invention, its advantages can be appreciated. The level of ink can be precisely controlled without direct contact with the ink and while the ink surface is disturbed by an agitator. Variations from the described embodiment may occur to one skilled in the art. For example, the echo loss simulator network may be in digital form to accommodate a digital ink level signal generator. Also, a plurality of ink controls may be used. The scope of the invention, therefore, should be determined by the following claims.

What is claimed is:

1. An apparatus for automatically controlling the level of ink in an ink fountain used in a printing press by regulating the feed of ink from a supply through a valve to the fountain comprising ultrasonic ink level sensing means remotely spaced from the ink fountain for directing ultrasonic pulses at the ink fountain to generate an echo signal representative of ultrasonic returns from the surface of the ink;

means responsive to the echo signal for generating a measured ink level signal indicative of the operating level of ink in the ink fountain;

means for producing an operating ink level reference signal representative of a desired ink level in the fountain;

means for comparing the measured ink level signal with the operating ink level reference signal to generate an ink feed signal when the ink level in the fountain drops below the operating level;

means repsonsive to the ink feed signal for generating ink feed pulses spaced by the intervals of a predetermined duration selected commensurate with the time period needed to enable ink supplied during a preceding pulse to register a change in the measured ink level signal and enabling the flow of ink through said valve to the ink fountain during said ink feed pulses;

means for detecting when an echo signal fails to be generated in response to an ultrasonic pulse directed at the ink fountain and producing an echo loss signal indicative thereof and applying said echo loss signal to effectively inhibit the flow of ink through said valve to the ink fountain.

2. The ink level control apparatus as claimed in claim 1 wherein said means for detecting the echo loss alarm further includes means for delaying said echo loss signal until said echo loss signal has persisted for a predetermined time selected commensurate with normal ink fountain operating conditions.

3. The ink level control apparatus as claimed in claim 1 and further including means for generating a low ink level reference signal representative of a lowest acceptable ink level in the ink fountain; and means for comparing the low ink level reference signal with the measured ink level signal to generate a low ink level alarm signal when the signal level in the ink fountain drops below the lowest acceptable ink level and applying said low ink level alarm signal to effectively inhibit the flow of ink through said valve to the ink fountain.

4. An apparatus for automatically controlling the level of ink in an ink fountain used in a printing press by regulating the feed of ink from a supply through a valve to the fountain comprising ultrasonic ink level sensing means remotely spaced from the ink fountain for directing ultrasonic pulses at the ink fountain to generate an echo signal representative of ultrasonic returns from the surface of the ink;

means responsive to the echo signal for generating a measured ink level signal indicative of the operating level of ink in the ink fountain;

means for producing an operating ink level reference signal representative of a desired ink level in the fountain;

means for comparing the measured ink level signal with the operating ink level reference signal to generate an ink feed signal when the ink level in the fountain drops below the operating level;

means responsive to the ink feed signal for generating ink feed pulses spaced by intervals of a predetermined duration selected commensurate with the time period needed to enable ink supplied during a preceding pulse to register a change in the measured ink level signal and enabling the flow of ink through said valve to the ink fountain during said ink feed pulses;

means for detecting when an echo signal fails to be generated in response to an ultrasonic pulse directed at the ink fountain and producing an echo loss signal indicative thereof and apply said echo loss signal to effectively inhibit the flow of ink through said valve to the ink fountain; and means responsive to the echo loss signal for establishing a simulated measured ink level signal indicative of an acceptable ink level in the fountain while said echo loss signal is active.

5. The ink level control apparatus as claimed in claim 4 wherein said means for generating the measured ink level signal further includes means producing a voltage whose magnitude is representative of the ink level in the fountain; and wherein said means for establishing said simulated measured ink level signal further includes means for clamping said voltage to a magnitude representative of an acceptable ink level in the fountain when said echo loss occurs.

6. The ink level control apparatus as claimed in claim 4 wherein said means for generating the measured ink level signal further includes digital storage means for storing a digital signal representative of the ink level in the fountain as the measured ink level signal; and wherein said means for establishing a simulated ink level signal further includes means for retaining a previously generated stored digital signal as representative of the ink level in the fountain while an echo loss signal occurs.

7. An apparatus for automatically controlling the level of ink in an ink fountain used in a printing press by regulating the feed of ink from a supply through a valve to the fountain comprising ultrasonic ink level sensing means remotely spaced from the ink fountain for directing ultrasonic pulses at the ink fountain to generate an echo signal representative of ultrasonic returns from the surface of the ink;

means responsive to the echo signal for generating a measured ink level signal indicative of the operating level of ink in the ink fountain, means for producing an operating ink level reference signal representative of a desired ink level in the fountain;

first comparing means for comparing the measured ink level signal with the operating ink level reference signal to generate an ink feed signal when the ink level in the fountain drops below the operating level;

means responsive to the ink feed signal for generating ink feed pulses spaced by intervals of a predetermined duration selected commensurate with the time period needed to enable ink supplied during a preceding pulse to register a change in the measured ink level signal and enabling the flow of ink through said valve to the ink fountain during said ink feed pulses;

means for producing a low ink level reference signal representative of a minimum acceptable ink level in the fountain;

second comparing means for comparing the measured ink level signal with the low ink level reference signal to generate a low ink level alarm signal when the ink level in the fountain drops below the minimum acceptable ink level; and means responsive to the low ink level alarm signal for effectively inhibiting the effect of the ink feed signal to disable further supply of ink and register an alarm condition representative of said low ink level.

8. The ink level control apparatus as claimed in claim 7 wherein said means for effectively inhibiting the effect of the ink feed signal is coupled to said first comparing means for disablement thereof upon occurrence of an ink level below said minimum acceptable level in the ink fountain.

9. The ink level control apparatus as claimed in claim 7 and further including means for producing a high ink level reference signal representative of a maximum acceptable ink level in the fountain;

third comparing means for comparing the measured ink level signal with the high ink level reference signal to generate a high ink level alarm signal when the ink level in the fountain exceeds the maximum acceptable level for a predetermined time period.

10. The ink level control apparatus as claimed in claim 9 wherein said means for generating the high ink level alarm signal further includes timer means effectively coupled to the output of the third comparing means for generating said high ink level alarm signal after said high ink level in the fountain has persisted for a predetermined minimum time period.

11. An apparatus for automatically controlling the level of ink in an ink fountain used in a printing press by regulating the feed of ink from a supply comprising ultrasonic ink level sensing means remotely spaced from the ink fountain for directing ultrasonic pulses at the ink fountain and generate echo signals representative of ultrasonic reflections from the surface of the ink;

means responsive to the echo signals for generating a measured ink level signal indicative of the level of ink in the fountain;

means for producing an operating ink level reference signal representative of a desired ink level in the fountain;

means for comparing the measured ink level signal with the operating ink level reference signal to generate an ink feed signal when the ink level in the fountain drops below the desired ink level;

means for generating high and low ink level reference signals respectively representative of range limits of acceptable ink levels in the fountain;

means for comparing the high and low ink level reference signals to the measured ink level signal and generate respectively high and low ink level alarm signals when the ink level in the fountain is no longer within the acceptable range limits; and means responsive to the ink feed signal for generating ink feed pulses separated by ink leveling intervals, said intervals being selected of sufficient duration to enable ink supplied during a previous pulse to establish a new ink level.

12. The ink level control apparatus as claimed in claim 11 and further including means for detecting a loss of echo signals and generate an echo loss signal indicative thereof; and means actuated by the echo loss signal for producing a simulated ink level signal representative of an ink level within the acceptable range limits.

13. The ink level control apparatus as claimed in claim 12 and further including means for generating an alarm signal when said echo loss is active for a predetermined time.

14. An apparatus for automatically controlling the level of ink in an ink fountain used in a printing press by regulating the feed of ink from a supply through a valve to the fountain comprising ultrasonic ink level sensing means remotely spaced from the ink fountain for directing ultrasonic pulses at the ink fountain to generate an echo signal representative of ultrasonic returns from the surface of the ink means responsive to the echo signal for generating a measured ink level signal averaged over a desired number of echo signals to smooth out effects from variations in the measured ink level signal as a result of surface movements thereof;

means for producing an operating ink level reference signal representative of a desired ink level in the fountain;

means for comparing the averaged measured ink level signal with the operating ink level reference signal to generate an ink feed signal when the ink level in the fountain drops below the operating level.

15. The ink level control apparatus as claimed in claim 14 and further including means for detecting when an echo signal fails to be generated by the ultrasonic ink level sensing means in response to an ultrasonic pulse directed at the ink fountain and producing an echo loss signal indicative thereof; and means for simulating a measured ink level signal in response to the echo loss signal and of a magnitude selected to prevent overflow of ink from the ink fountain.

* * * * *